US006189543B1

(12) United States Patent
Sonstegard

(10) Patent No.: US 6,189,543 B1
(45) **Date of Patent: *Feb. 20, 2001**

(54) DEVICE AND ACCESSORY FOR STYLING HAIR

(76) Inventor: Lois J. Sonstegard, 2320 Devin La., Orono, MN (US) 55356

( * ) Notice: Under 35 U.S.C. 154(b), the term of this patent shall be extended for 0 days.

This patent is subject to a terminal disclaimer.

(21) Appl. No.: 09/416,678

(22) Filed: Oct. 12, 1999

Related U.S. Application Data

(63) Continuation-in-part of application No. 08/986,369, filed on Dec. 8, 1997, which is a continuation-in-part of application No. 08/839,602, filed on Apr. 15, 1997, now Pat. No. 5,890,494, which is a continuation of application No. 08/512,041, filed on Aug. 7, 1995, now abandoned, which is a continuation-in-part of application No. 08/336,485, filed on Nov. 9, 1994, now abandoned.

(51) Int. Cl.[7] ..... A45D 8/04; A45D 8/34; A45D 8/36

(52) U.S. Cl. ..... 132/275; 132/276; 132/246; 132/247

(58) Field of Search ..... 132/246, 247, 132/273, 275, 222, 233; 63/3, 11; 24/575, 576, 579.1

(56) References Cited

U.S. PATENT DOCUMENTS

| | | | | |
|---|---|---|---|---|
| 1,024,566 | | 4/1912 | Gifford | 24/575 |
| 1,538,809 | | 5/1925 | Henry . | |
| 1,945,932 | | 2/1934 | Caley . | |
| 2,378,872 | | 6/1945 | Stone | 132/273 |
| 2,415,914 | | 2/1947 | Silverman | 132/273 |
| 2,649,097 | | 8/1953 | Chernack | 132/273 |
| 4,161,806 | | 7/1979 | Hennisse et al. | 24/579.1 |
| 4,186,465 | | 2/1980 | Manning | 24/575 |
| 4,572,221 | * | 2/1986 | Barrades | 132/273 |
| 4,760,715 | | 8/1988 | Ramos, Jr. | 63/3 |
| 4,834,118 | | 5/1989 | Goeller . | |
| 5,115,825 | | 5/1992 | Kuhn | 132/273 |
| 5,144,968 | * | 9/1992 | Rivera | 132/247 |
| 5,343,608 | | 9/1994 | MacDonald | 63/3 |
| 5,535,765 | | 7/1996 | Takashima | 132/273 |
| 5,890,494 | * | 4/1999 | Sonstegard | 132/273 |

FOREIGN PATENT DOCUMENTS 2130393 12/1994 (CA) .

* cited by examiner

*Primary Examiner*—Pedro Philogene
(74) *Attorney, Agent, or Firm*—Kinney & Lange, P.A.

(57) ABSTRACT

A device for styling hair includes a flexible. relatively long body portion having a separating opening therein through which to receive a user's hair. This body portion has clasp portions extending from either end which can be closed into a corresponding clasp by the insertion of one portion in the other so as to prevent rotation of one with respect to the other, and to engage a detente arrangement therebetween. A suitable surface finish on a synthetic polymer material for the side members provides a desired coefficient of friction on that surface with respect to hair thereagainst. A styling enhancement may be provided as part of the hair styling device.

29 Claims, 10 Drawing Sheets

Fig. 11
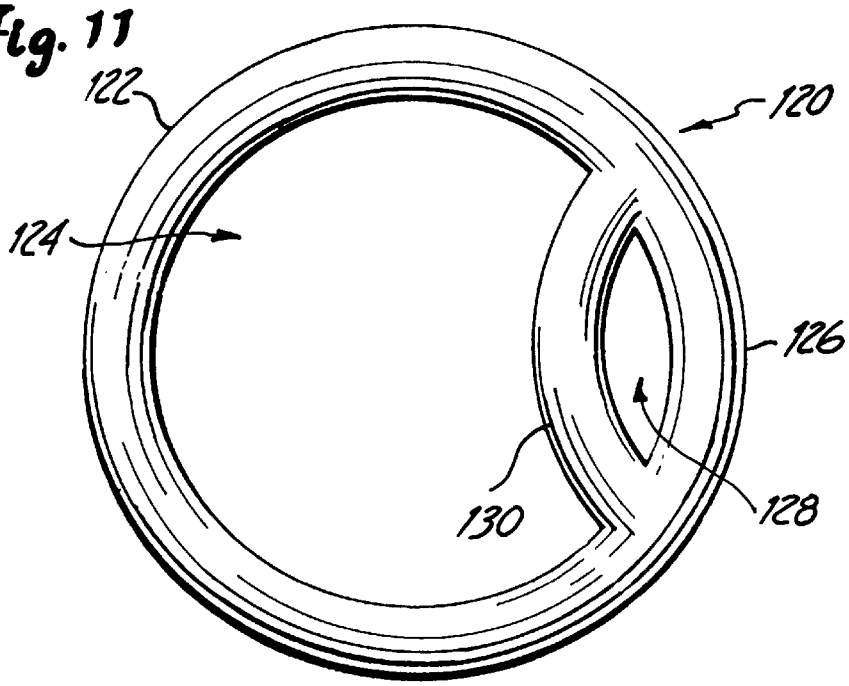
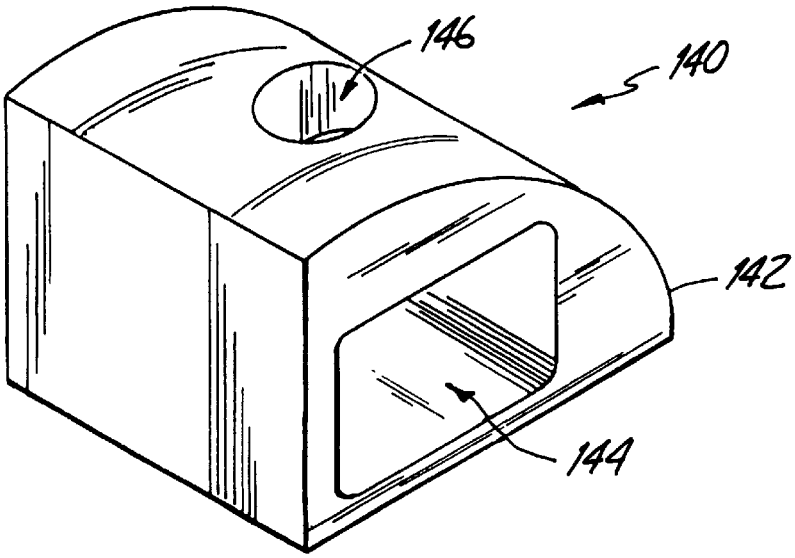
Fig. 12
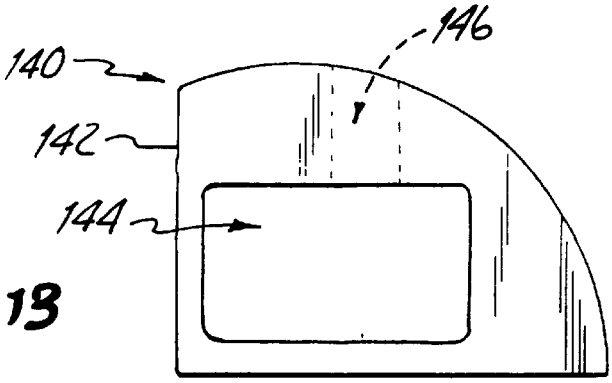
Fig. 13

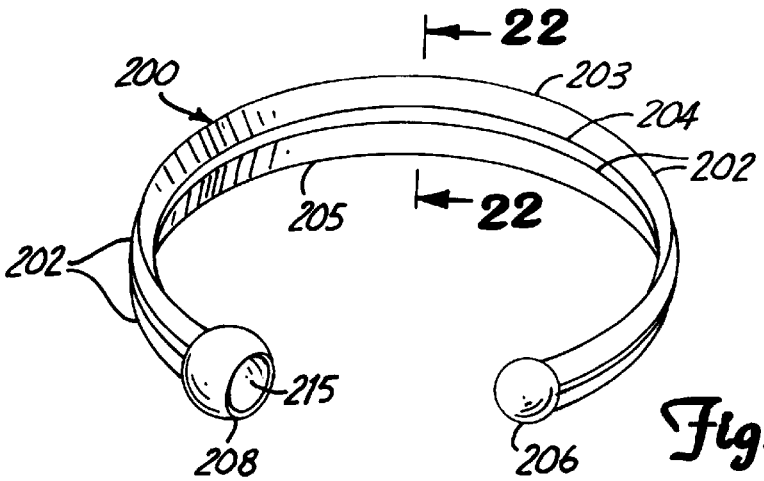
Fig. 21
Fig. 22
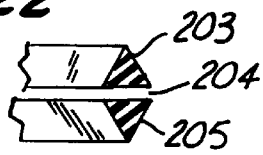
Fig. 23
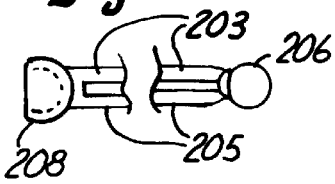
Fig. 24
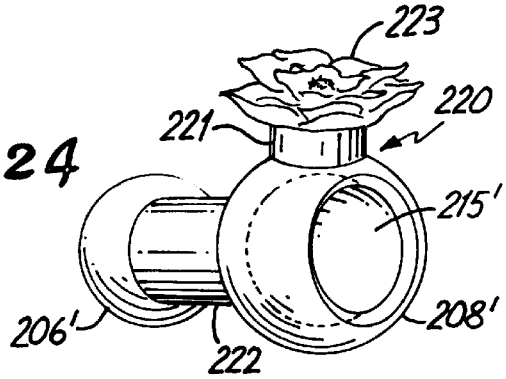
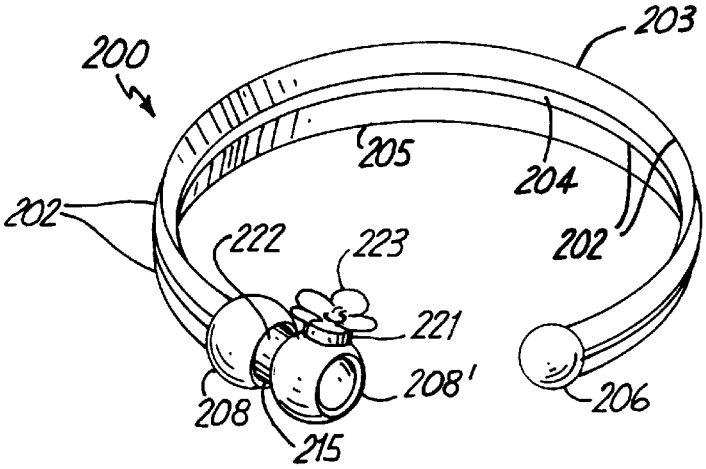
Fig. 25

DEVICE AND ACCESSORY FOR STYLING HAIR

CROSS-REFERENCE TO RELATED APPLICATIONS

This application is a continuation-in-part application of U.S. patent application Ser. No. 08/986,369, filed Dec. 8, 1997, which is a continuation-in-part application U.S. patent application Ser. No. 08/839,602, filed Apr. 15, 1997, U.S. Pat. No. 5,890,494 which is a continuation of U.S. patent application Ser. No. 08/512,041 filed Aug. 7, 1995, now abandoned, which was a continuation-in-part application of U.S. patent application Ser. No. 08/336,485, filed Nov. 9, 1994, now abandoned.

BACKGROUND OF THE INVENTION

The present invention relates to hair styling devices, namely devices for forming French knots, buns and the like, and in particular, to an attachment accessory for conveniently attaching hair styling enhancements to the hair styling device.

Long hair styles are popular with people of all ages, particularly with women. Because of the popularity of long hair styles, several devices have been invented for styling long hair. Examples include barrettes, hair ties, combs and ornamental hair pins.

Of the hair styling devices that are currently known, there are included a few devices which are useful for styling long hair into a bun, a French knot, or similar style.

One such device is a soft sponge-like ring. The ring is covered with a fine netting material, which can be used by drawing the hair through the opening in the sponge, wrapping the hair around the ring and securing the hair onto the ring by trapping the hair and the netting material together with hair pins. The ring can also be formed from a fabric, such as woven nylon covered with a nylon netting. Typically, the ring has an outer diameter of approximately four inches and has an inner diameter of approximately two inches.

There are disadvantages in using a soft sponge-like ring to form a hair bun. Smooth, thick hair is difficult to wrap around the ring, pin the hair down and have the hair remain in place. Wrapping the hair around the ring is also quite time consuming when the hair is long. Shorter hair may not be possible to wrap completely around the ring.

There are flexible combs that are known having two ends which can be opened to install the comb around the hair, and then closed to form a substantially circular ring. Flexible combs have many sharp, pointed edges which can scrape the scalp. Such a comb is also not particularly useful for styling hair into a bun. The flexible combs described above are primarily intended to be used to form French knots.

There are currently no known hair styling devices which can be used to rapidly and easily form a French knot, bun or similar hair style and to which a hair styling enhancement, such as a flower or other ornament, may be optionally attached to the hair styling device with an attachment accessory.

BRIEF SUMMARY OF THE INVENTION

The present invention is a hair styling device including an attachment accessory for attaching hair styling enhancements to the hair styling device. The invention includes a flexible elongated body portion and either a rigid, semi-rigid, or flexible attachment accessory in slidable engagement with the body portion. The elongated body portion includes a first end, a second end and an elongated slit opening extending through a central portion of the elongated body for receiving hair through the slit opening. The slit opening is generally along the long axis of the body portion between the first and second end, thus dividing the central portion into a first rib and a second rib. A substantially wider opening may be created in the slit opening by deforming the elongated body.

The attachment accessory includes a main body having a first hole, or aperture, through the main body adapted for receiving the elongated body portion in slidable telescoping engagement through the first hole. The main body includes a second hole, or aperture, through the main body adaptable for attaching a hair styling enhancement.

The invention in its broadest sense also includes an optional hair securing portion, proximate the slit opening, suitable for securing hair positioned in the opening. An example of securing portion includes an elongated body formed from a material that will deform under force, and either return to its original shape in response to withdrawing the force or in response to application of an opposite force.

The above and other objects and advantages of the present invention will become more readily apparent when reference is made to the following description, taken in conjunction with the accompanying drawings, and are in no way intended to limit the scope of the present invention.

BRIEF DESCRIPTION OF THE DRAWINGS

FIG. 11 is a front side elevational view of an embodiment of an attachment accessory improvement of the present invention;

FIG. 12 is a perspective view of another embodiment of the attachment accessory improvement of the present invention;

FIG. 13 is a side elevational view of the embodiment depicted in FIG. 12;

FIG. 21 is a perspective view of another embodiment of the hair styling device of the present invention;

FIG. 22 is a cross-sectional view of the embodiment depicted in FIG. 21;

FIG. 23 is a side elevational view of the embodiment of FIG. 21 with the middle portion thereof omitted and with the first and second ends unattached;

FIG. 24 is a perspective view of another embodiment of the attachment accessory improvement of the present invention;

FIG. 25 is a perspective view of the embodiment of the attachment accessory improvement of the present invention shown in FIG. 24 that is shown with the hair styling device of the present invention in FIG. 21;

DETAILED DESCRIPTION

The present invention is a novel device for styling hair. The device of the present invention is particularly suited for use with long hair, and more particularly for forming buns and French knots.

Figure 1:
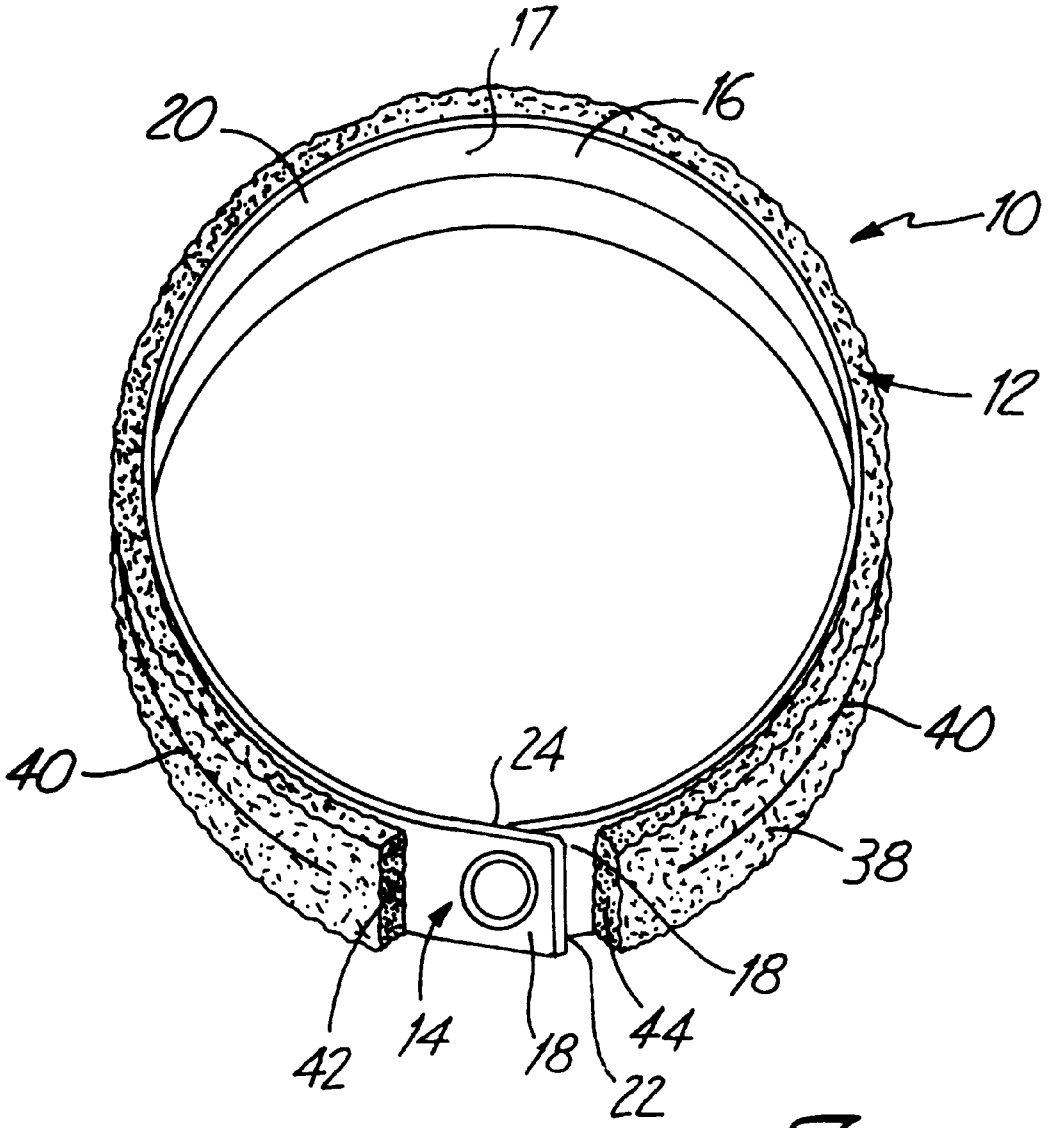
FIG. 1 is a perspective view of an embodiment of the present invention, shown with first and second ends attached.

A perspective view of a hair styling device 10 is shown in FIG. 1. Hair styling device 10 includes an elongated body portion 12 which includes a support strip 14 having a first end 22, a second opposite end 24 and an elongated slit opening 16, extending along the longitudinal axis of body portion 12, between first end 22 and second end 24 and dividing support strip 14 into a first rib 17 and a second rib 19. Support strip 14 is preferably made with a flexible material, which in one embodiment is approximately 10⅜ inches in length, about ¾ inch in width and has a thickness of approximately 1/16 inch.

Support strip 14 maybe made from a resilient material which returns to its original shape when a force causing deformation is subsequently removed. Such a material may be polyvinyl chloride which can be flexed repeatedly and which returns to its original shape. Another example of a suitable plastic that can be used to form support strip 14 is high density polyethylene (HDPE) which is widely available, for example, from Primex Plastics Corporation of Richmond, Ind.

Figure 2:
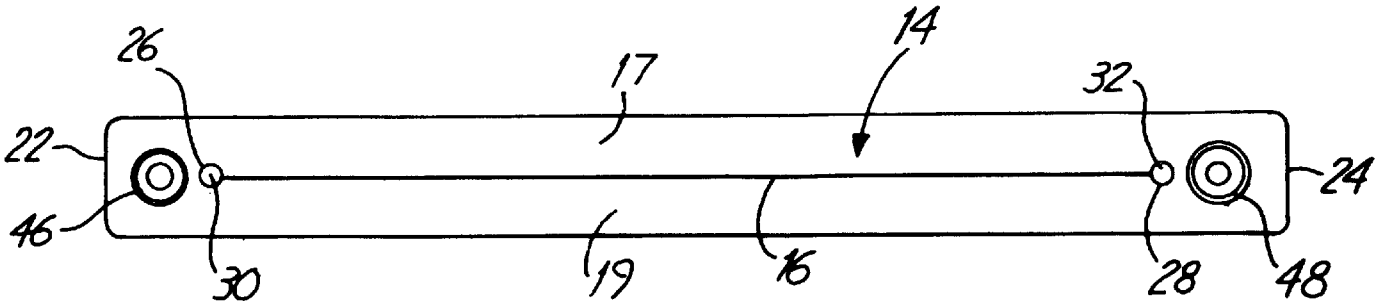
FIG. 2 is a side elevational view of the embodiment of FIG. 1 with the first and second ends unattached.

Hair styling device 10 includes elongated slit opening 16 for receiving at least a portion of a person's hair therethrough, wherein support strip 14 is deformed in order to create a substantially wider opening for receiving the hair. In the present invention, this opening is a longitudinal slit extending completely through support strip 14 from a first major surface 18 to a second major surface 20. Referring now to FIG. 2, elongated slit opening 16 is shorter in length than a length of support strip 14, and stopping short of first end 22 and second end 24. Elongated slit opening 16 has a first end 26 and a second end 28, each end terminating in a substantially circular opening 30, 32. In one embodiment, the circular openings are approximately ⅛ inch in diameter. Openings 30 and 32 are provided to allow elongated slit opening 16 to be opened wide enough to easily insert at least a portion of the person's hair.

Figure 3:
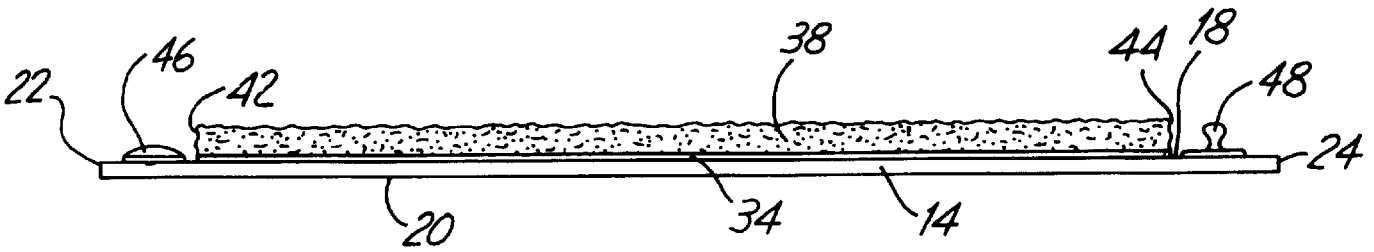
FIG. 3 is a top plan view of the embodiment of FIG. 2.

Referring to FIG. 1, either first major surface 18 or second major surface 20 may also have a high coefficient of friction so that hair positioned within elongated slit opening 16 and wrapped around body portion 12 does not easily slide out of elongated slit opening 16. A high coefficient of friction may be provided by a foam strip 38, preferably an open cell foam having a thickness of approximately ¼ inch, which is affixed to either first major surface 18 or second major surface 20 by means of an adhesive layer 34, as depicted in FIG. 3. An example of a suitable foam is polyurethane open cell foam available from Future Foam, Inc. of Council Bluffs, Iowa (A Nebraska corporation) under the product designation "30100." The foam strip has a minimum elongation of 125 percent, a maximum compression set of 10 percent at 50 percent C.O.M., an indention force deflection at 25 percent of 4 inches, a density of 1 pound per cubic foot, plus or minus 1/10, a minimum tensile strength of 10 pounds per square inch and a minimum tear strength of 1.25 pounds per inch. All of the physical characteristics described above are measured in accordance with ASTM-D-3574-88.

The adhesive used in adhesive layer 34, for use with this foam and the high density polyethylene plastic strip 14, is available from Maple Leaf Sales, Ltd., of Plymouth, Mich. under the trade name "K-Grip Solvent Cement."

Preferably, support strip 14 is formed by means of injection molding. Elongated slit opening 16 and circular openings 30 and 32 are cut into the strips after the strips are released from the mold. The adhesive layer 34 can be brushed or sprayed onto either major surface 18 or major surface 20. Preferably, the adhesive is applied in the form of a spray, and the foam is applied to the adhesive.

Foam strip 38 also has a longitudinal cut 40 which extends through the thickness of foam strip 38 and is aligned with elongated slit opening 16 of support strip 14. Preferably, foam strip 38 covers a majority of either first or second major surfaces 18, 20, but has ends 42 and 44 which are located far enough from ends 22 and 24, respectively, to allow sufficient clearance for providing means for removably attaching the first and second ends 22 and 24 to each other.

Hair styling device 10 is equipped with a fastening means for removably attaching first end 22 to opposite second end 24. Referring to FIGS. 2 and 3, a conventional snap 46, 48 is provided to secure first end 22 to second end 24 after the device is in place in a person's hair. Although snaps were chosen as the preferred fastening means, the present invention also contemplates the use of a hook and loop type closure such as a product available under the trade name "Velcro", a hook and eye, a button and button hole, an elongated slit and pin with an enlarged head, a hook and loop configuration with a transverse loop to guide the ends together, and any other conventional fastening devices.

In operation, the user applies force to support strip 14 in a manner which deforms first rib 17 and second rib 19 creating an opening defined by inner edges of elongated slit opening 16. The hair to be styled is placed through the opening. Each end 22 and 24 is grasped and hair styling device 10 is rotated about its longitudinal axis until the hair is wrapped around the elongated body 12 and positioned in the desired location. At this point, ends 22 and 24 are either drawn together and fastened, forming a "bun" style, or the ends are concealed within the hair and pinned into place, forming a "French knot."

Figure 4:
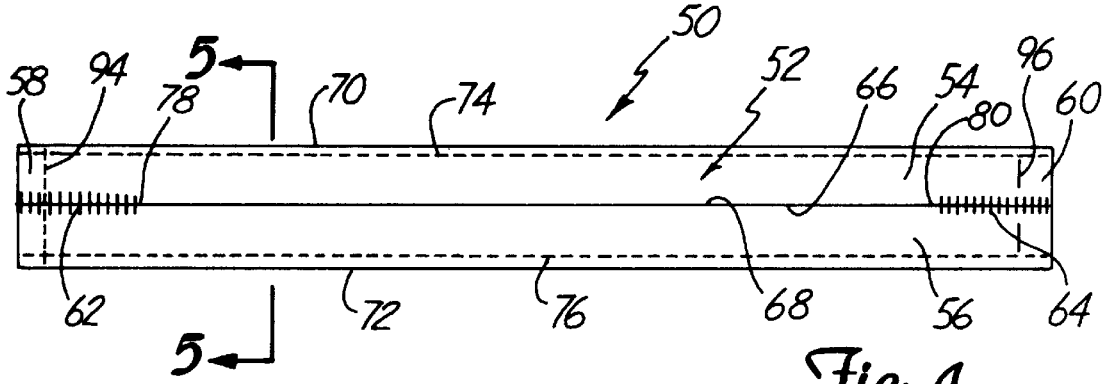
FIG. 4 is a side elevational view of another embodiment of the present invention.

A second embodiment of the present invention is shown at 50 in FIG. 4. In this embodiment, an elongated body portion 52 is formed of a flexible, deformable material that lacks an ability to return to its initial shape when a deformation force is removed. Elongated body portion 52 of this embodiment is formed from a cloth material that has a high coefficient of friction. Preferably the elongated body is constructed from woven cotton. Other woven materials such as terry cloth, muslin, wool, netting and fleece would also be suitable.

Elongated body portion 52 comprises two substantially identical sleeves 54, 56 which are tacked together at each ends 58, 60 by means of end stitching 62, 64. Ends 58, 60 may also be tacked together by means of metal clips (not shown). The construction of hair styling device 50 is shown in cross-section in FIG. 5.

Figure 5:
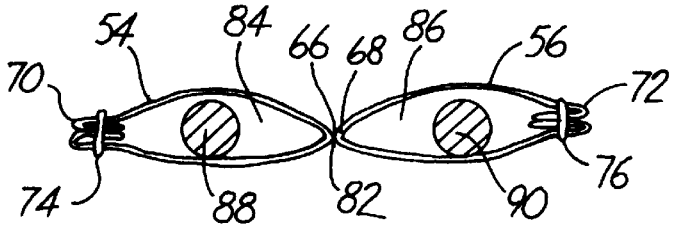
FIG. 5 is a cross-sectional view of the embodiment depicted in FIG. 4, taken through line 5—5 as shown in FIG. 4.

In FIG. 5, each sleeve 54, 56 is folded to form first folded edges 66, 68 and second opposite enfolded edges 70, 72. Raw edges of the fabric are enfolded, and edges 70, 72 are stitched together by means of stitching 74, 76. Both sleeves 54 and 56 define elongated body 52.

First folded edges 66 and 68 extending from inner edges 78, 80 of end stitches 62 to 64 define the elongated opening 82 of the second preferred embodiment. Because the elongated body in this example is formed of flexible fabric, it is necessary to add a deformable material to pockets 84, 86 located within sleeves 54 and 56. Preferably, 8 gauge copper wires 88, 90 are positioned within the pockets 84 and 86 and extend beyond end stitching 62 and 64 toward ends 58 and 60, respectively.

Figure 6:
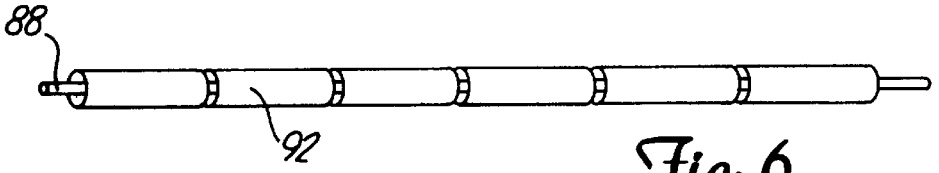
FIG. 6 is a perspective view of a wire portion of the embodiment depicted in FIG. 4, the wire extending through a plurality of semi-rigid plastic tubes.

Although it is believed that hair to be styled with the device of the present invention is adequately protected from the wires 88 and 90 by the sleeves 54 and 56, in another embodiment, plastic tubing is placed over the wire before insertion into each sleeve 54, 56. As shown in FIG. 6, plastic tubing segments 92 can be placed over each wire 88, 90 (not shown) for greater protection of the hair against damage. Flexible tubing can also be used, which would eliminate the need to cut the tubing into segments prior to sliding over the wires 88 and 90. Referring back to FIG. 4, after the wires 88 and 90 are inserted into the sleeves 54 and 56, the ends 58 and 60 are enfolded and stitched together, forming stitching 94 and 96. The stitching 94 and 96 traps the wires 88 and 90 permanently in the sleeves 54 and 56.

In operation, the sleeves 54 and 56 are drawn apart by the application of force. Hair to be styled is placed in an elongated opening 82 defined by separated edges 66 and 68. Then, force is applied to the wires 88 and 90 in a direction opposite the force applied to create the opening. Each end 58 and 60 is grasped, and then twisted until the hair has reached the desired shape. Then, the ends may be secured together, in the case of forming a hair bun, or the ends may be turned under and pinned, forming a French knot.

Although no fastening means is shown in FIG. 4, it would be desirable to include a fastener at each end such as a hook and loop marketed under the trade name "Velcro". The addition of the fastening arrangement in the case of both the first and second embodiments increases the utility of this device. Devices of the present invention with end closures are particularly suited for forming buns.

Another embodiment of the hair styling device of the present invention is illustrated generally at 100 in FIGS. 7-10 which includes a main body 102 having an elongated slit 104 dividing main body 102 into a first rib 103 and a second rib 105 and terminating, in the longitudinal axis, in a male end 106 and an opposing female end 108. Both ends 106, 108 are oriented along the longitudinal axis of main body 102. Male end 106 includes a detent hole 116. Female end 108 defines a tunnel 115 including a nub 114, on an interior wall of tunnel 115.

Main body 102 is preferably constructed as a unitary main body made from a flexible injection-molded, polymeric material. The polymeric material preferably has a surface with a coefficient of friction that is effective for securing hair to main body 102 when positioned in elongated slit 104. One acceptable polymer for use in this embodiment of the present invention is Santoprene®, a thermoplastic elastomer manufactured by Monsanto Corp. of St. Louis, Miss. The hair styling device of the present invention may have a range of acceptable lengths and widths. For hair styling device 100, preferred lengths range from about five inches to about eight inches. In one embodiment, the device has a width of one-half inch. Apart from the ends, the device, in one embodiment, has a maximum thickness of about one-eighth inch.

Main body 102 includes a constrictor section 110 adjacent to female end 108 and an opposing constrictor section 112 adjacent to male end 106. The constricting sections 110 and 112 define the longitudinal extent of elongated slit 104. The constrictor sections 110 and 112 are thinner than other sections of main body 102, best appreciated in FIG. 9.

Figure 7:
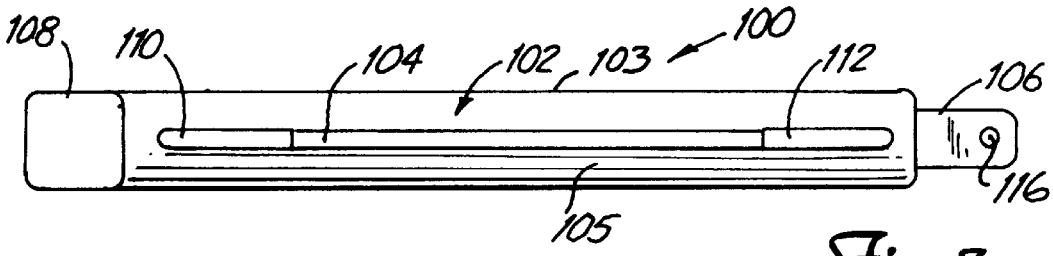
FIG. 7 is a front side elevational view of another embodiment of the present invention.
Figure 8:
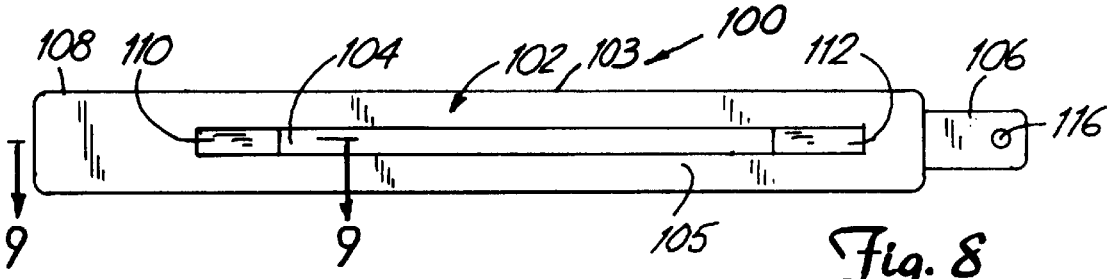
FIG. 8 is a back side elevational view of the embodiment of the present invention depicted in FIG. 7.
Figure 9:
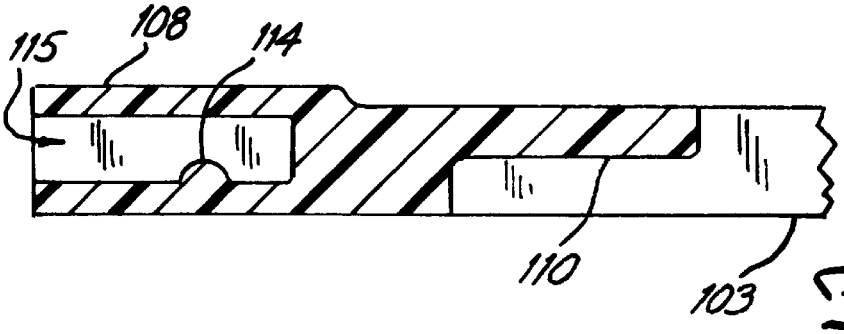
FIG. 9 is a cross-sectional view of a female portion of a clasp mechanism of the embodiment of the present invention depicted in FIG. 7.

The constricting sections 110 and 112 are integral with the main body 102 as is shown in an elevational view of the bottom of the styling device, in FIGS. 7–9. Further, female end 108 and male end 106 are also integral with the elongated main body 102 and made from the same material as main body 102.

Figure 10:
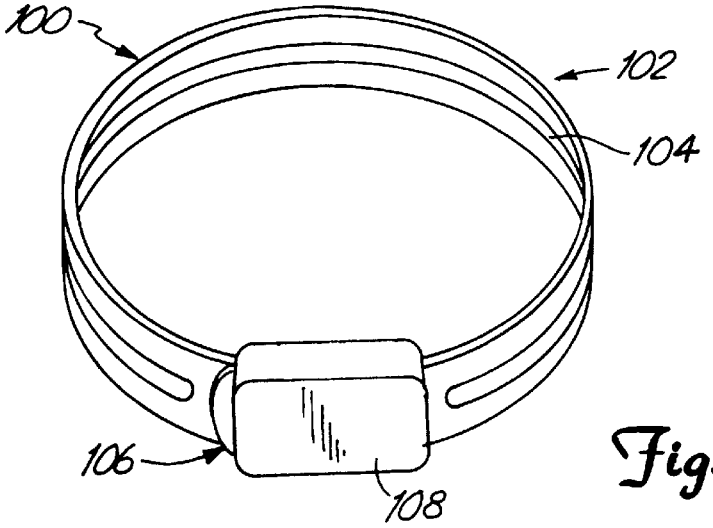
FIG. 10 is a perspective view of the embodiment depicted in FIG. 7, shown with first and second ends attached.

The hair styling device is secured to a person's hair in a like manner as described for styling device 10 above. To fasten hair styling device 100, male end 106 is inserted into female end 108 as shown in FIG. 10. Nub 114 is suitable for resting in detent hole 116 when ends 106, 108 are brought together and male end 106 is inserted into female end 108 along the longitudinal axis of main body 102. The flexible and deformable properties of the injection-molded material used to make the third embodiment 100 of the present invention permits the male end 116 to pass over the nub 114 and "catch" the nub at the hole 116. The nub 114 and tunnel 115 trap the male end 106.

FIG. 11 depicts a first embodiment of an attachment accessory 120 which includes a main body 122 having a first hole 124, or aperture, through main body 122, and a minor body 126 joined to main body 122 so as to have a second hole, or aperture 128, formed by the juncture of minor body 126 to main body 122 with a divider 130 common to both holes 124,128. Attachment accessory 120 may be constructed from many types of materials such as polymers and metals. Preferably, attachment accessory 120 is constructed out of a flexible resilient polymer to provide for deformability to conform to the shape of the hair styling device, particularly female end 108 of hair styling device 100, yet remain in a slidable telescoping relationship therewith.

FIGS. 12 and 13 show an alternative embodiment for an attachment accessory 140 which includes a main body 142 having an open bore 144 along a first axis and a hole 146 through a wall of main body 142 communicating with open bore 144. As shown, open bore 144 is rectangular in cross-section to closely fit the preferred shape for female end 108. The present invention anticipates that female end 108 and open bore 144 may assume any complimentary shape and still function within the scope of the present invention. Hole 146 is adaptable to accommodate any number of attachable enhancements. The means for attaching the enhancements may be quite variable and no attempt is made to limit the scope of various types and methods of attachment. Attachment accessory 140 may be constructed from many types of materials such as polymers and metals. Preferably, attachment accessory 120 is constructed out of a semi-rigid polymer to provide for a good fit with, and against, the more resilient material of hair styling device 100.

Figure 14:
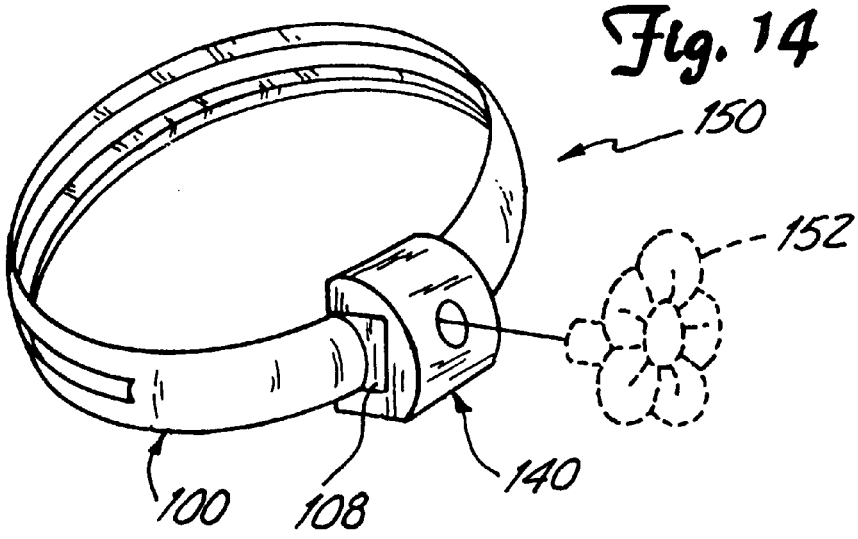
FIG. 14 is a perspective view of the attachment accessory embodiment of FIG. 12 in slidable telescoping relationship to the hair styling device of FIG. 10.

Attachment accessory 140 in conjunction with hair styling device 100, is shown in use in FIG. 14, as a combined embodiment of a hair styling device 150. For ease of depiction, a person's hair has not been shown, but hair styling device 150 is closed as it would be after placing hair through the opening of the device and then twisting to wrap the hair around the device. Attachment accessory 140 has been placed over female end 108 and an enhancement 152, shown in phantom, is being attached to attachment accessory 140.

Figure 15:
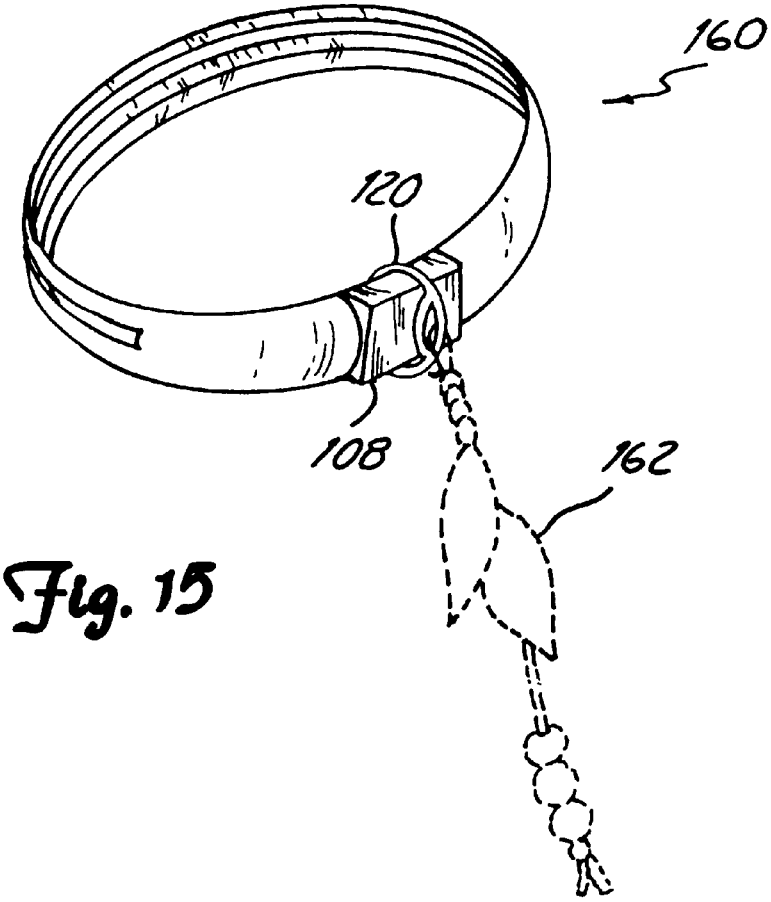
FIG. 15 is a perspective view of attachment accessory embodiment of FIG. 11 in slidable telescoping relationship to the hair styling device of FIG. 10.

Attachment accessory 120 in conjunction with hair styling device 100, is shown in use in FIG. 15, as a combined preferred embodiment of a hair styling device 160. For ease of depiction, a person's hair has not been shown, but hair styling device 160 is closed as it would be after placing hair through the opening of the device and then twisting to wrap the hair around the device. Attachment accessory 120 has been placed over female end 108 and an enhancement 162, shown in phantom, is attached to attachment accessory 120.

Figure 16:
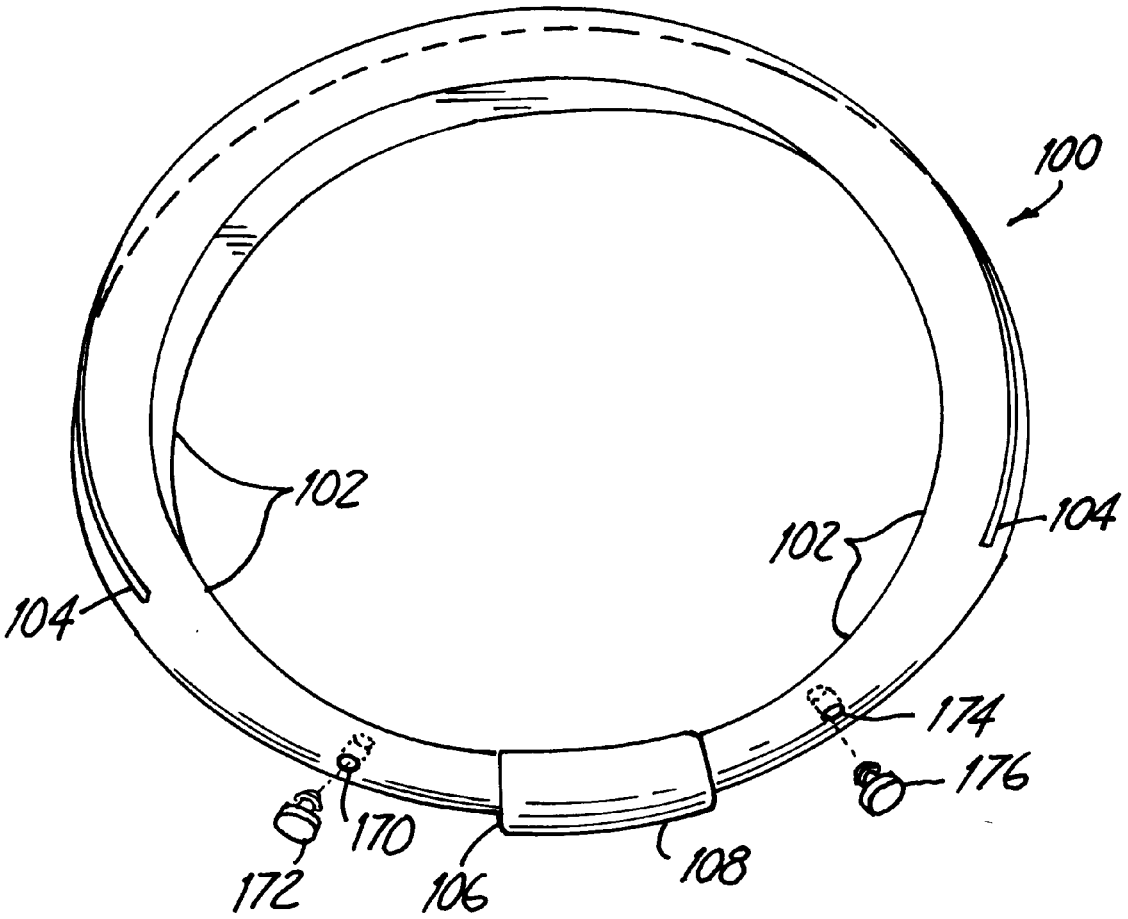
FIG. 16 is a perspective view of another embodiment of the hair styling device of the present invention.

A further arrangement for attachment accessories is shown in FIG. 16. Main body 102 past the end of slit 104 near male end 106 has a recess, or hole, 170, provided therein capable of accepting and holding an attachment accessory in the form of a stud, 172, having a circular disk mounted on the end of a stem that has a ring shaped protrusion near its opposite end. Similarly, main body 102 past the other end of slit 104 near female end 108 has a further recess, or hole, 174, provided therein again capable of receiving and holding another, similar attachment accessory stud, 176.

Figure 17:
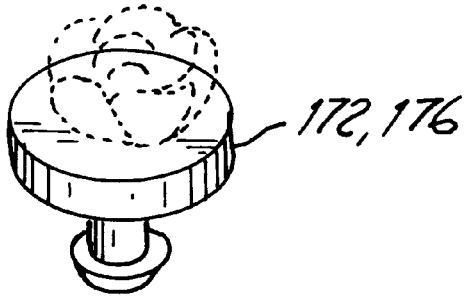
FIG. 17 is a perspective view of another embodiment of the attachment accessory improvement of the present invention.

Attachment accessory assessment studs 172 and 176 can be formed of either a suitable metal or polymer material to provide the typical shape shown therefor in FIG. 17. As can be seen in FIG. 17, a decorative enhancement, shown in the form of a polymer based blossom simulation structure, can be fastened to the stud by an adhesive or other suitable fastening means. Studs 172 and 176 can be used with openings 170 and 174 in main body 102 in some situations concurrently with the use of such attachment accessories as those designated 120 and 140 shown in use in FIGS. 14 and 15.

Figure 18:
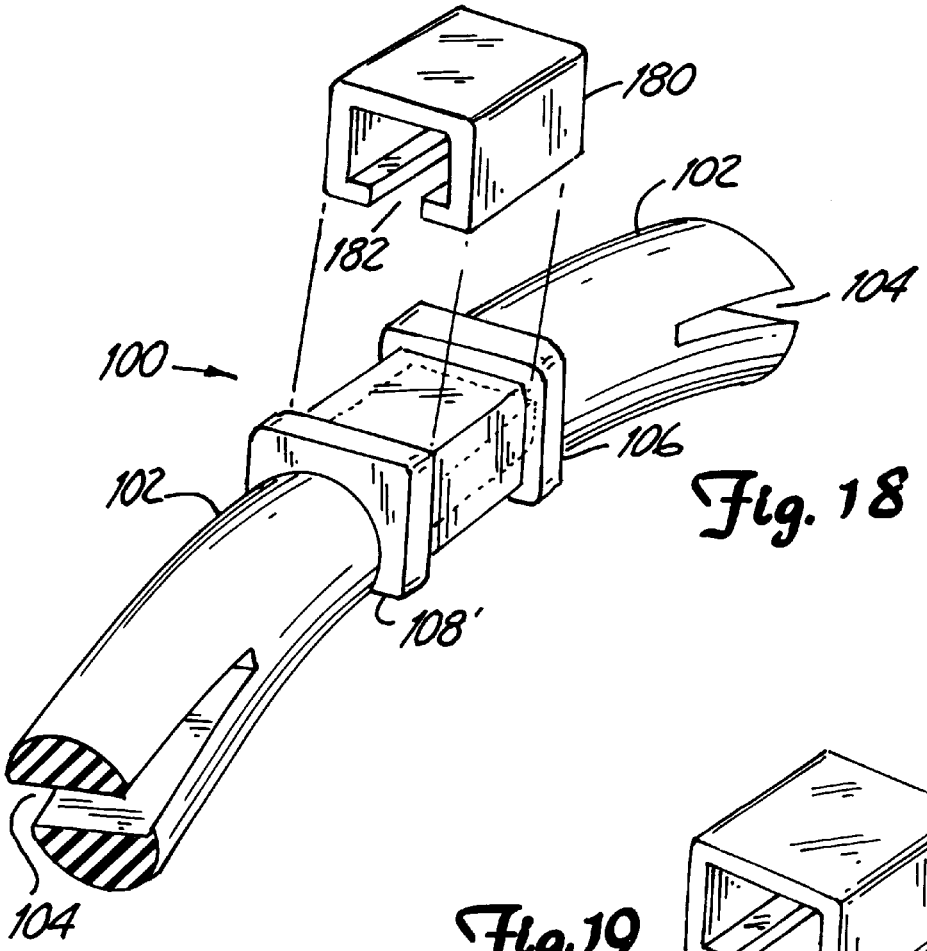
FIG. 18 is a perspective view of another embodiment of the attachment accessory improvement of the present invention shown with a portion of the hair styling device of the present invention of FIG. 7 with a modification.

A further alternative for providing an attachment accessory for use with hair styling device 100 is shown in FIG. 18 where female end 108 shown in FIGS. 7 through 10, 14 and 15 used with that device has been modified to have interior portions thereof between a pair of end portions thereof with outer surfaces that are set back or inward from the outer surfaces defined by those end portions. Thus, a modified female end, 108', is shown FIG. 18 as a hollow, rectangular shaped box, open at one end, having a resulting interior region channel between the opposite end portions in at least three of the box walls so that the set back surfaces in those walls form the bottom of the channel.

This channel can accept therein a resilient material, hollow rectangular shell shaped clip, 180, as an attachment accessory having a slit, 182, extending from end to end in one of the rectangular shell walls thereof (could alternatively be a complete shell without a slit and used as a slip-over sleeve with or without a channel in the female end of the device). Clip 180 can have the remainders of the wall with slit 182 therein spread apart along that slit to permit forcing the clip over the interior portions of female end 108' forming the channel therein. Then, after allowing the spread apart sides to snap together once these sides have passed about the ends of in the channel region in female end 108', next removing the spreading force to thereby permit clip 180 to clasp that female end.

Figure 19:
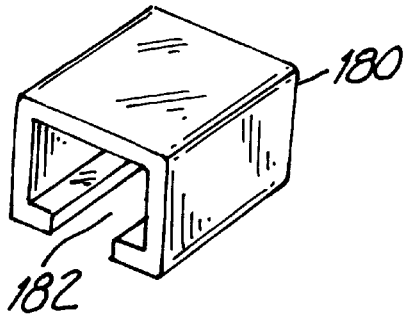
FIG. 19 is a perspective view of the embodiment of the attachment accessory improvement of the present invention shown in FIG. 18.
Figure 20:
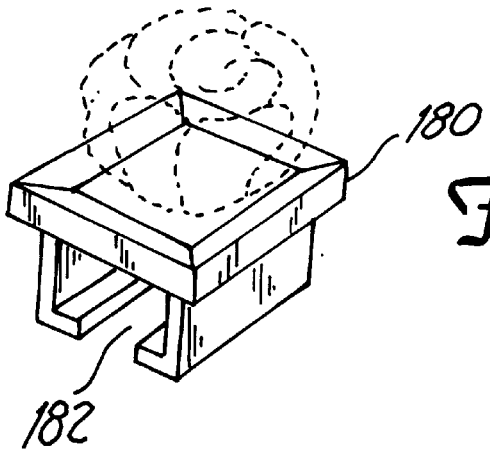
FIG. 20 is a perspective view of another embodiment of the attachment accessory improvement of the present invention.

Clip 180 is shown in FIG. 19 as having an outer planer surface on each of its whole rectangular shell walls including the one across from the further side with slit 182 therein. Thus, an decorative enhancement can be provided attachable to such a wall or walls. Clip 180 is shown in FIG. 20 with the side opposite the side having slit 182 therein formed with a depression or recess therein to better enable it to receive and hold a polymer based blossom simulation structure, for instance, by adherence. The depression provides for the presence of a greater amount of adhesive to give an increased opportunity for that adhesive to contact that simulation structure.

Clip 180 is typically formed of a polymer material such as polypropylene. This material is different than the material in female end 108' and typically has a resilience exhibiting a greater "spring constant" than the end material so that it will snugly adhere in the channel to female end 108'. A material like polypropylene with a low resin allows better adherence thereto of other kinds of materials in forming an ornamental enhancement as well as for coverings thereover such as various paints, and permits easier etching thereof should a geometric shape change be desired after the original forming of clip 180.

Thus, attachment accessory 120 of FIGS. 11 and 15, and attachment accessory 140 of FIGS. 12, 13 and 14 are used with female end 108 to provide various means of adding decorative enhancements or ornaments to hair styling device 100. Similarly, clip 180 as an attachment accessory shown in FIGS. 18, 19 and 20 is also used with female end 108' to provide a further alternative means for mounting an decorative enhancement to hair styling device 100. Further decorative enhancements or ornaments can be added through providing more foundations for attachment accessories.

One manner of accomplishing this goal is to effectively form an intermediate connector comprising for one end thereof a female end like female ends 108 or 108', and for the other end thereof a male end 106. Joining or combining a pair of such ends results in an intermediate connector providing a further foundation for supporting an attachment accessory can be used with hair styling device 100.

That is, an intermediate connector is formed by joining approximately one half thereof that is shaped much like male end 106 with another half thereof that is shaped like female end 108 or 108'. The resulting intermediate connector can have an outer surface provided in series with the outer surface of female end 108 or 108' in hair styling device 100 by inserting male end 106 of device 100 inserted in the female part of this intermediate connector and inserting the male part of this intermediate connector in the corresponding one of either female end 108 or 108'. Thus, there would be consecutively positioned surfaces on a structure like female end 108 or 108' of the intermediate connector and on female end 108 or 108' of device 100 each of which could have an attachment accessory provided therewith for mounting a decorative enhancement or ornament. If desired, a further such intermediate connector could be provided so that there would be three such surfaces with the middle one providing spacing between the female end structures on either side thereof to thereby allow a further spacing apart of any enhancements provided with the two end surfaces in the sequence through corresponding accessory attachments used therewith.

An example of an intermediate connector arrangement of a slightly different configuration will be shown in connection with a further hair styling device, 200, shown in FIG. 21. Device 200 again has a main body, 202, with a slit, 204, extending lengthwise therein that is formed by two separated ribs, 203 and 205, but which has a male end, 206, and a female end, 208, that differ from male end 106 and either of female ends 108 and 108' of hair styling device 100. Ends 206 and 208 provide a symmetrical geometric configuration clasp when joined together by insertion, as opposed to the asymmetrical geometric configuration clasp formed by the insertion joined ends of hair device 100.

Slit 204 comes very close to reaching ends 206 and 208 in hair styling device 200, and has thinner ribs 203 and 205 of a triangular cross section as shown in FIG. 22 thereby differing from ribs 103 and 105 of hair styling device 100. As a result, hair styling device 200 can be shortened with respect to hair styling device 100 and yet exhibit a greater flexibility to allow easy forming of hair buns, hair knots, and french twists, especially helpful in forming ones of relatively small dimensions.

Male end 206 is in the form of substantially a solid sphere to which ribs 203 and 205 are attached in parallel at corresponding off center locations with a smaller sphere quarter section, or so, also joined to the solid spherical sphere at a corresponding location adjacent both the ribs 203 and 205 such that these ribs are also attached to this quarter sphere.

Female end 208 is formed as a truncated hollow spherical shell with ribs 203 and 205 attached to one side thereof on the opposite side of this shell from an circular opening, 215, in the shell created by such truncating, this opening providing access to the hollow spherical shaped interior of the shell. The truncation of the spherical shell occurs at a position more than a radius of the spherical internal hollow away from the location where ribs 203 and 205 join that shell thereby leaving the diameter of circular opening 215 at a value less than the maximum diameter of the spherical internal hollow of that shell.

This spherical shell, as well as the rest of hair styling device 200, is typically made of the same polymer as hair styling device 100 so that the shell walls are resilient. The diameter of the solid sphere on male end 206 is then chosen to be approximately the same diameter as the maximum diameter of the spherical internal hllow within the spherical shell of female end 208. In such an instance, the solid sphere on male end 206 can be inserted through opening 215 by forcibly stretching the walls about that opening to a greater diameter in doing so, thereby permitting this solid sphere to then enter the spherical internal hollow in female end 208. Because the truncation creating circular opening 215 is located more than an interior spherical hollow radius away from the opposite side of the shell, the solid sphere of male end 206, after entering the spherical internal hollow of female end 208 through forced insertion, will be captured therein since the shell wall of female end 208 will extend past that equatorial plane of the solid sphere of male end 206 that is perpendicular to the axis of the plane of circular opening 215. This will be so no matter what angle ribs 203 and 205, attached to the solid sphere forming male end 206, have with respect to the axis of the plane of circular opening 215. The narrowed connection of ribs 203 and 205 to the solid sphere of male end 206 and to the quarter sphere support therefore allows these ribs to have a substantial angular excursion from the axis of the plane of circular opening 215 to thereby provide further flexibility to hair styling device 200.

The film resilience of the spherical shell of female end 208 requires a significant force to remove the solid sphere of male end 206 from the spherical interior hollow therein so that these two ends joined together form a clasp which significantly resists separating these two end from one another. Because of the similarity in the diameters of the solid sphere as part of male end 206 and the maximum diameter of the spherical hollow in female end 208, the insertion of this solid sphere into that hollow forces much of the air out that was precedently in that hollow. As a result, removing the solid sphere of male end 206 from the spherical hollow of female end 208 by forcibly pulling it through opening 215 results in a temporary vacuum which is filled within rushing air so as to form a popping sound at the moment of removal.

Returning now to the use of an intermediate connector to provide an additional surface in forming an attachment accessory to allow the mounting of a decorative ornament thereon, FIG. 24 shows such an intermediate connector, 220. As indicated above, half of intermediate connector 220 is formed as though it were a male end 206 of hair styling device 200 so that it can fit into opening 215 of female end 208 of hair styling device 200 as shown in FIG. 25, this half of connector 220 being designated 206'. The remaining half of intermediate connector 220 is formed as though it were female end 208 of hair styling device 200 except for the provision of a mounting platform, 221, thereon to give it an accessory attachment function, this second end of connector 220 with this platform thereon being designated 208'. Ends 206' and 208' of connector 220 are interconnected to one another by cylindrical bar, 222.

Figure 26:
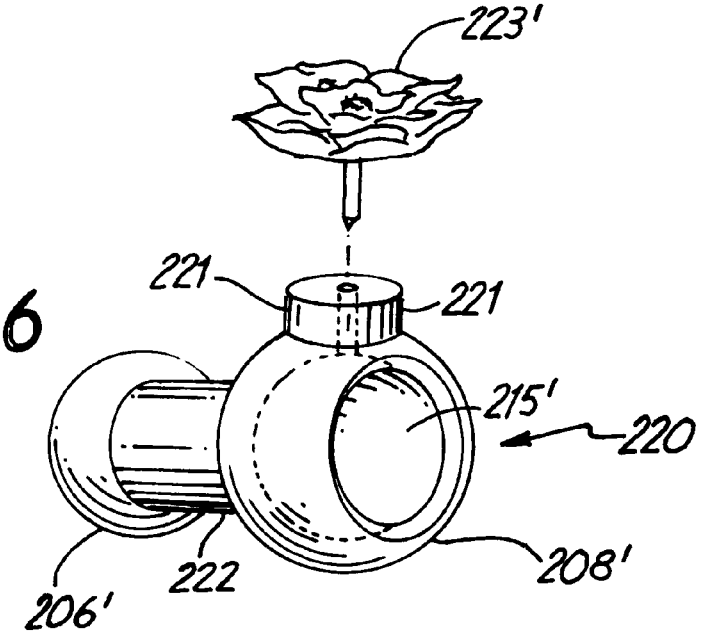
FIG. 26 is a perspective view of the embodiment of the attachment accessory improvement of the present invention shown in FIG. 24 adapted in one manner to receive a decorative enhancement.

The material of interconnector 220 can be the same polymer as that of hair styling device 200, but may be chosen to be of a different material since it need not hold hair, and because a different material may be more easily used with an adhesive to mount a decorative enhancement, or with a metal stud for the same purpose. Thus, the choice of a polymer for forming connector 220 can lead to suitable resilient characteristics for the spherical shell wall of female member 208' but at the same time provide a depression in mounting platform 221 to provide a increase surface area for adhesive used to mount a decorative enhancement such as the polymer based blossom simulation structure, 223, shown in FIG. 24. The proper choice of a polymer will allow platform 221 to harden in the mold so as to have a depressed central region. A different selection of a polymer will result in platform 221 being flat which can accommodate the mounting of a polymer based blossom simulation structure, 223', mounted on a stem or stud which is inserted into a flatter surface platform 221 is shown in FIG. 26.

Ribs 203 and 205, having a triangular prismatic shape in cross section, enhances their ability to hold hair that is inserted in slit 204 therebetween. The ribs contact the hair and three sharp points, in addition to the sides thereof, which creates an increased gripping capacity for holding the hair when combined with rolling the hair up into a bun, knot or twist in using hair styling device 200 which is accomplished in much the manner as hair was rolled up with hair styling device 100. However, the smaller, more flexible triangular cross section ribs allows the user to roll a relatively small bunch of hair into a bun, knot or twist without that small amount of hair easily slipping out of slot 204.

Figure 27:
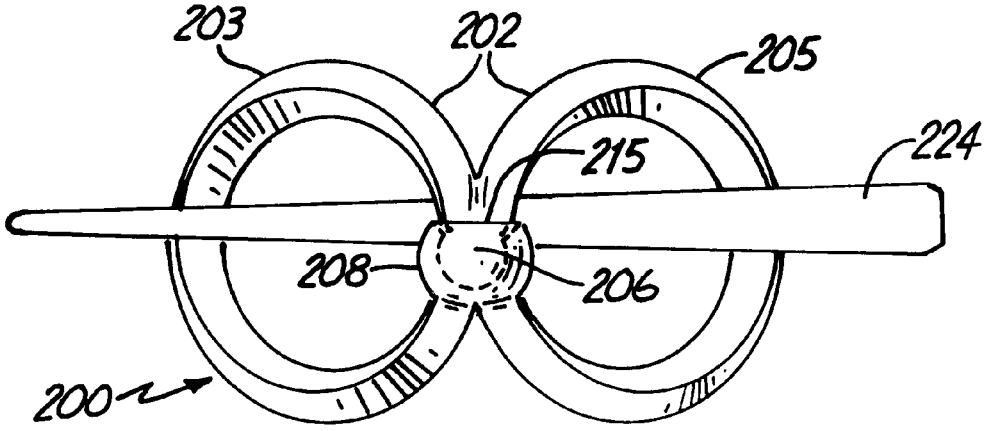
FIG. 27 is a perspective view of another embodiment of the attachment accessory improvement of the present invention shown with the hair styling device of the present invention in FIG. 21.

In addition, slit 204 in main body 202, in reaching nearly both male end 206 and female end 208, allows a further configuration than the single, more or less circular configuration for hair styling device 200 resulting from inserting male end 206 into female end 208 through opening 215 as is suggested by the showing of device 200 in FIG. 27. Instead, that spilt sided circle configuration can be separated along slit 204 so that a two circular configuration results that is formed from each of ribs 203 and 205 when more completely separated, which ribs will tend to come back into adjacent parallel alignment with one another. The use of a hair pin, 224, prevents ribs 203 and 205 from coming into such a parallel and adjacent relationship with one another. In this arrangement, bunches of hair can be grasped in each of the circles by those circles and the hair pin to provide a different look for the user.

Although the present invention has been described with reference to preferred embodiments, workers skilled in the art will recognize that changes may be made in form and detail without departing from the spirit and scope of the invention.

What is claimed is:

1. A hair styling device for styling a person's hair through engagement therewith, the hair styling device comprising:

a hair holder comprising:

a flexible relatively long body portion extending between two ends thereof having a pair of side members over part of its length because of a separation opening extending through the body portion over that part of the length, and a first end clasp portion and a second end clasp portion each extending from a corresponding one of the opposing ends of the body portion, a selected one of the first and second end clasp portions having an insert stub with a radially asymmetric cross section and the other clasp portion having at least one resilient wall extending substantially along an insert direction that defines at least a portion of an opening therein with a cross section similar to the cross section of the insert stub but large enough to receive the insert stub therein, the wall and the insert stub each having at a side thereof a corresponding member of a detent pair comprising a projection member and a recess member that are against one another when the insert stub is sufficiently inserted along the corresponding extent directions into the other clasp portion through the opening; and an attachment accessory with a selected one of this attachment accessory and the hair holder having at least one hole therein through which the other passes at least in part, and further having a support therein suitable for supporting a hair styling enhancement.

2. The device of claim 1 wherein each of the first end clasp portion, the second end clasp portion and the body portion are of a common material.

3. The device of claim 1 wherein the side members are made of a material having a surface coefficient of friction high enough to prevent a user's hair from slipping between the side members after placement thereof through the separation opening between the side members when other portions of that hair are then wrapped around the body portion.

4. The device of claim 2 wherein the hair holder is formed of a synthetic polymer.

5. The device of claim 1 wherein the attachment accessory is formed of a polymer.

6. The device of claim 3 wherein the side members of the body portion are formed of a synthetic polymer having a surface finish that provides a coefficient of friction effective for securing the hair thereto so as to prevent slipping of that hair.

7. A hair styling device for styling a person's hair through engagement therewith, the hair styling device comprising:

a flexible, relatively long body portion extending between two ends thereof having a pair of side members over part of its length because of a separation opening extending through the body portion over that part of the length, and a first end clasp portion and a second end clasp portion each extending from a corresponding one of the opposing ends of the body portion, a selected one of the first and second end clasp portions having an insert stub with a radially asymmetric cross section and the other clasp portion having at least one resilient wall extending substantially along an insert direction that defines at least a portion of an opening therein with a cross section similar to the cross section of the insert stub but large enough to receive the insert stub therein, the wall and the insert stub each having at a side thereof a corresponding member of a detent pair comprising a projection member and a recess member that are against one another when the insert stub is sufficiently inserted along the corresponding extent directions into the other clasp portion through the opening.

8. The device of claim 7 wherein each of the first end clasp portion, the second end clasp portion and the body portion are of a common material.

9. The device of claim 7 wherein the side members are made of a material having a surface coefficient of friction high enough to prevent a user's hair from slipping between the side members after placement thereof through the separation between the side members when other portions of that hair are then wrapped around the body portion.

10. The device of claim 8 wherein the hair styling device is formed of a synthetic polymer.

11. The device of claim 9 wherein the side members of the body portion are formed of a synthetic polymer having a surface finish that provides a coefficient of friction effective for securing the hair thereto so as to prevent slipping of that hair.

12. The device of claim 7 wherein the body portion has a hole at least partly therethrough located between the separation opening and a selected one of the first and second end clasp portions.

13. The device of claim 7 wherein the first and second end clasp portions have a slider thereabout that has two opposing sides joined together by a joining side located therebetween.

14. The device of claim 7 wherein there is further provided an intermediate clasp insert having a pair of clasping structures provided on corresponding sides thereof one of which approximates the shape of at least part of the first end clasp portion and the other of which approximates the shape of at least part of the second end clasp portion.

15. A hair styling device for styling a person's hair through engagement therewith, the hair styling device comprising:

a flexible, relatively long body portion extending between two ends thereof having a pair of side members over nearly all of its length because of a separation opening extending through the body portion over that part of the length, and a first end clasp portion and a second end clasp portion each extending from a corresponding one of the opposing ends of the body portion in a corresponding extent direction substantially parallel to the direction the body portion extends from that end, a selected one of the first and second end clasp portions having an insert stub and the other clasp portion being an equatorial plane capture means in which the insert stub is positionable such that the equatorial plane capture means can rotate in multiple directions about the insert stub with the equatorial plane capture means having at least one resilient wall that defines at least a portion of an opening therein and the opening having a cross section similar to the cross section of the insert stub large enough to receive the insert stub therein but only after the insert stub stretches the wall in being positioned therein.

16. The device of claim 15 wherein said insert stub is generally spherical in shape except where that clasp portion in which it is provided extends from said body portion.

17. The device of claim 15 wherein each of the first end clasp portion, the second end clasp portion and the body portion are of a common material.

18. The device of claim 15 wherein the side members are made of a material having a surface coefficient of friction high enough to prevent a user's hair from slipping between the side members after placement thereof through the separation opening between the side members when other portions of that hair are then wrapped around the body portion.

19. The device of claim 15 wherein the first end clasp portion, the second end clasp portion and the body portion form a hair holder and further comprising an attachment accessory with a selected one of this attachment accessory and the hair holder having at least one hole therein through which the other passes at least in part, and further having a support therein suitable for supporting a hair styling enhancement.

20. The device of claim 15 wherein there is further provided an intermediate clasp insert having a pair of clasping structures provided on corresponding sides thereof one of which approximates the shape of at least part of the first end clasp portion and the other of which approximates the shape of at least part of the second end clasp portion.

21. The device of claim 17 wherein the hair styling device is formed of a synthetic polymer.

22. The device of claim 18 wherein the side members of the body portion are formed of a synthetic polymer having a surface finish that provides a coefficient of friction effective for securing the hair thereto so as to prevent slipping of that hair.

23. The device of claim 19 wherein the attachment accessory is formed of a polymer.

24. A hair styling device for styling a person's hair through engagement therewith, the hair styling device comprising:

a flexible, relatively long body portion extending between two ends thereof having a pair of side members over nearly all of its length because of a separation opening extending through the body portion over that part of the length, and a first end clasp portion and a second end clasp portion each extending from a corresponding one of the opposing ends of the body portion with each of the first and second end clasp portions having an open region therewith large enough to receive therein at least a part of the other so that each of the first and second end clasp portions can at least in part be positioned about at least a part of the other so as to each capture the other when so positioned as against forces subsequently occurring that tend to pull them apart.

25. The device of claim 24 wherein each of the first end clasp portion, the second end clasp portion and the body portion are of a common material.

26. The device of claim 24 wherein the side members have a holding arrangement sufficient to prevent a user's hair from slipping between the side members after placement thereof through the separation opening between the side members when other portions of that hair are then wrapped around the body portion.

27. The device of claim 25 wherein the hair styling device is formed of a synthetic polymer.

28. The device of claim 26 wherein the side members of the body portion are formed of a synthetic polymer having a surface finish that provides a coefficient of friction effective for securing the hair thereto so as to prevent slipping of that hair.

29. The device of claim 24 wherein the body portion has a hole at least partly therethrough located between the separating slit and a selected one of the first and second end clasp portions.

* * * * *